United States Patent [19]

Brunet et al.

[11] 4,448,578

[45] May 15, 1984

[54] CURING OVEN FOR ENAMELED WIRE AND CONTROL SYSTEM THEREFOR

[75] Inventors: George A. Brunet, Hennepin County; Richard J. Cowan, Dakota County, both of Minn.

[73] Assignee: Acrometal Products, Inc., Minneapolis, Minn.

[21] Appl. No.: 526,276

[22] Filed: Aug. 25, 1983

Related U.S. Application Data

[63] Continuation of Ser. No. 373,797, Apr. 30, 1982, abandoned.

[51] Int. Cl.[3] ..... F27B 9/28; F24H 1/00; C21D 9/54

[52] U.S. Cl. ..... 432/72; 266/103; 432/59; 432/223

[58] Field of Search ..... 432/8, 59, 72, 222, 432/223, 37; 266/102, 103

[56] References Cited

U.S. PATENT DOCUMENTS

| | | | |
|---|---|---|---|
| 3,106,386 | 10/1963 | Harris . | |
| 3,183,605 | 5/1965 | Argue et al. | 432/72 |
| 3,351,329 | 11/1967 | Thomas | 432/8 |
| 3,604,824 | 12/1971 | Hardison | 432/72 |
| 3,677,335 | 7/1972 | Weatherston | 165/12 |
| 3,806,314 | 4/1974 | Obuchi et al. | 432/230 |
| 3,810,736 | 5/1974 | Dumas | 432/59 |
| 3,918,892 | 11/1975 | Shindo et al. | 432/36 |
| 3,923,449 | 12/1975 | Brock | 432/59 |
| 4,140,467 | 2/1979 | Ellison et al. | 432/72 |
| 4,176,162 | 11/1979 | Stern | 432/210 |
| 4,198,764 | 4/1980 | Ellison et al. | 34/32 |
| 4,217,090 | 8/1980 | Whike et al. | 432/8 |
| 4,217,091 | 4/1980 | Whike et al. | 432/8 |
| 4,219,324 | 8/1980 | Zahniser | 432/26 |
| 4,231,167 | 11/1980 | Duris | 34/66 |
| 4,240,787 | 12/1980 | Jamaluddin | 432/21 |
| 4,242,084 | 12/1980 | Jamaluddin | 432/1 |
| 4,253,821 | 3/1981 | Bradshaw | 432/2 |
| 4,303,387 | 12/1981 | Burke et al. | 432/59 |

FOREIGN PATENT DOCUMENTS 67245 2/1981 Italy .

OTHER PUBLICATIONS

James B. Owens, Regenerative Thermal Process for Enameling Ovens, 1/2:80, Wire Technology Article, 3 pages.

4/82 Issue of Wire Journal International, article entitled "The Energy-Savings(ES) Wire Enameling Oven".

2/82 Ad in the Wire Journal International.

*Primary Examiner*—John J. Camby

*Attorney, Agent, or Firm*—Merchant, Gould, Smith, Edell, Welter & Schmidt

[57] ABSTRACT

The specification discloses a curing oven (10) and a control system (120) therefor. The oven (10) includes a heat exchanger (70) which preheats process air from the work chamber (36) before thermal oxidation. A separate recirculating fan (78), mixing box (84), and set of motorized dampers (92, 94) are provided for each zone (40, 42) of the work chamber (36) for controlling mixture of hot and cold air and delivery thereof to the work chamber for better temperature control. The motorized dampers (92, 94) are preferably controlled by microprocessors (124) responsive to temperature sensors (126, 128) located in the work chamber (36). Discharge of the exhaust fan (76) is adjusted by a motorized damper (96) through a controller (136) responsive to a pressure sensor (138) inside the oven (10).

25 Claims, 9 Drawing Figures

76
22
48
80
78
78
6
98
98
92
94
72
82
84
84
111
111
110
110
89
89
48
94
92
92
94
18
46
20
84
84
78
70
78
102
102
113
113
118
118
112
112
6
50
117
117
56
24

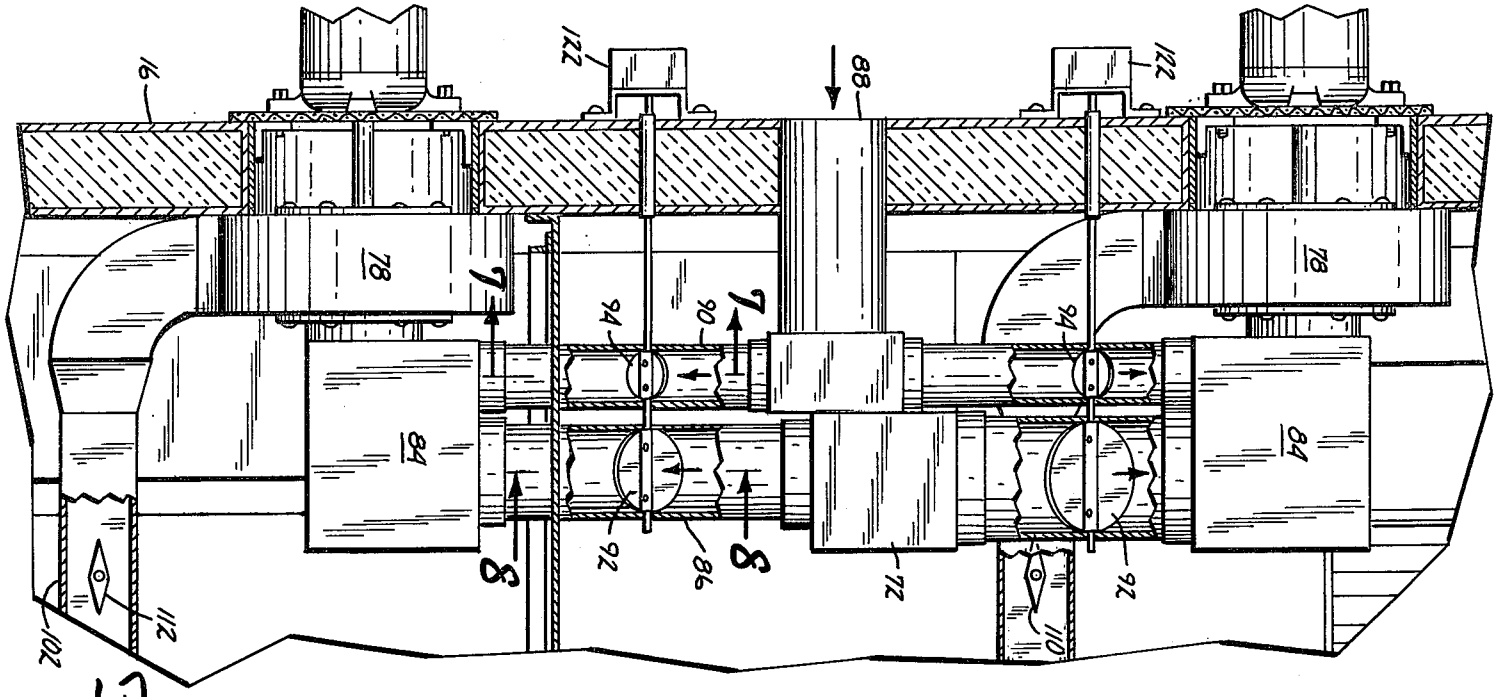
Fig.6
Fig.7
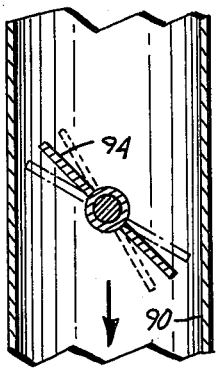
Fig.8
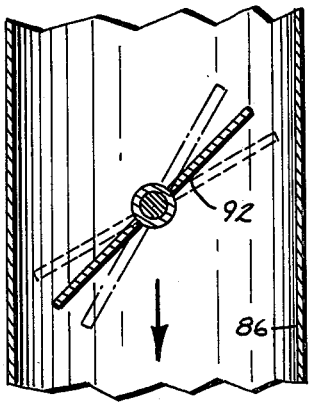

CURING OVEN FOR ENAMELED WIRE AND CONTROL SYSTEM THEREFOR

This is a continuation of application Ser. No. 373,797, filed Apr. 30, 1982, now abandoned.

TECHNICAL FIELD

The present invention relates generally to an oven for curing coated wire or the like on a continuous basis. More particularly, this invention concerns a wire enameling oven and control system therefor adapted to accommodate continual sensing and feedback of various conditions in order to achieve improved temperature control and distribution in the zones of the work chamber while maintaining environmental control.

BACKGROUND ART

Magnet wire is produced by coating conductive lengths of wire with a suitable insulator in liquid form and then feeding the coated wire through a curing oven on a continuous basis to dry the enamel. The wire is usually copper or aluminum and the insulator is typically enamel.

Traditionally, curing ovens have provided only elevated temperatures for proper curing of the enamel insulator; however, since such coatings give off volatile fumes during evaporation, the need soon became apparent for environmental control particularly with ovens having high production capacities.

There have been basically two distinct approaches to the problem of handling the evaporated solvents, which typically comprise hydrocarbons, from coatings during drying and curing. One approach has been to circulate air containing the unoxidized or partially oxidized vapors from the liquid coating through a burner, catalyst, or combination thereof to effect oxidation of the vapors. The use of a suitable catalyst, however, is expensive not only in terms of the initial expense in constructing the curing oven but also in terms of the periodic maintenance expense during shutdown of the oven to service the catalyst and remove accumulated deposits therefrom. On the other hand, the use of a burner to thermal oxidize the vapors creates other difficulties in maintaining proper temperature control within the oven due to wide temperature difference between the thermal oxidizer and the oven work chamber. Both approaches have their particular drawbacks and none of the ovens available heretofore has been completely satisfactory.

In addition, it will be appreciated that various parameters are involved including type and size of the wire, type and thickness of the coating material, rate of wire feed through the oven, etc., any one of which, if varied, could change the system balance sufficiently to require resetting, which is a manual process that can be time consuming and therefore expensive in terms of lost production. The set-up of a wire enameling oven for proper curing of the enamel and environmental control has been more of an art than a science. Different temperatures are required in zones of the work chamber to achieve evaporation then curing.

U.S. Pat. No. 3,106,386 to Harris, which is assigned to Acrometal Products, Inc., the assignee hereof, discloses a curing oven incorporating both a catalyst and a burner to effect oxidation. Heated air from the work chamber is subjected to the flame of a burner which partially oxidizes the fumes released from the enamel and carried by the air to a combustion chamber. The heated air, still containing some unoxidized fumes, is then passed through a catalyst for oxidation of the remaining fumes.

U.S. Pat. No. 3,810,736 to Dumas, which is also assigned to the assignee hereof, is an example of a curing oven which employs a burner alone to effect substantially complete thermal oxidation of the coating vapors. This oven comprises a casing with partitions therein dividing the interior into an elongated work chamber for receiving the coated wire, combustor inlet and outlet chambers interconnected by a combustor tube having a burner at the inlet end thereof, and gas passageways. A blower in the combustor outlet chamber moves air and heated gases through some passageways to opposite ends of the work chamber for passage through the curing and evaporating zones to pick up fumes evaporating from the enamel which are then carried back to the combustion inlet chamber for oxidation by the burner. In this oven, the heated air and gases from the combustor outlet chamber are mixed directly in the work chamber with the air inspirated through the open ends of the work chamber. Temperature control is achieved by setting manual dampers and by motorized volume control in order to throttle the amount of superheated air from the combustor outlet chamber with the "cold" outside air. Under conditions of reduced temperature requirements in the work chamber, proper temperature control and distribution becomes progressively more difficult to achieve due to the relatively small proportionate quantity of superheated air and combustion gases to be mixed with "cold" outside air. Moreover, any changes in the wire and coating parameters require manual readjustment of some dampers to rebalance the system. By reason of its control arrangement, the air flow in this oven could thus be characterized as constant temperature/variable volume.

A need has been developed for an improved wire enameling oven and control system therefor which is adapted to provide better temperature control and temperature distribution across the work chamber, and which is adapted to provide greater operating economy.

SUMMARY OF INVENTION

The present invention comprises wire enameling oven and control system therefor which overcomes the foregoing and other difficulties associated with the prior art. In accordance with the invention, there is provided an oven comprised of an elongated casing with partitions therein dividing the interior into an elongate work chamber with evaporating and curing zones, combustor inlet and outlet chambers interconnected by a combustor tube with a burner in the inlet and thereof, an intermediate (residence) chamber, and gas passageways. Process air from the evaporating and curing zones of the work chamber enters the intermediate chamber and passes through a heat exchanger where it is preheated before entering the upper inlet combustor chamber for feeding to the burner in order to effect substantially complete oxidation of any volatile fumes carried thereby. The superheated combustion products and air from the burner in the combustor tube pass through the heat exchanger from the lower combustor outlet chamber to a hot air plenum and on into mixing boxes for mixture with "cold" outside air before directing the mixture by recirculation fans back through the work chamber. Mixing of the cold outside air and superheated combustion air is automatically controlled by a microprocessor-based controller responsive to thermocouples positioned in the work chamber. Separate mixing boxes, motorized damper assemblies, and recirculation fans are provided for the zones of the work chamber. Excess superheated combustion air from the hot air plenum is exhausted by an exhaust fan through a motorized damper which is controlled by a controller responsive to a pressure sensor, located in the intermediate chamber of the oven. Since each recirculation fan operates at substantially constant volume and speed in accordance with the temperature requirements of its associated zone, the air flow through the oven herein can be characterized as constant volume/variable temperature in contrast to the oven disclosed in the '736 patent to Dumas.

BRIEF DESCRIPTION OF DRAWINGS

A better understanding of the invention can be had by reference to the following Detailed Description in conjunction with the accompanying Drawings, wherein:

FIG. 6 is an enlarged partial sectional view taken along lines 6—6 of FIG. 3 in the direction of the arrows;

FIGS. 7 and 8 are enlarged partial sectional views taken along lines 7—7 and 8—8, respectively, of FIG. 6 in the direction of the arrows.

DETAILED DESCRIPTION

Figure 1:
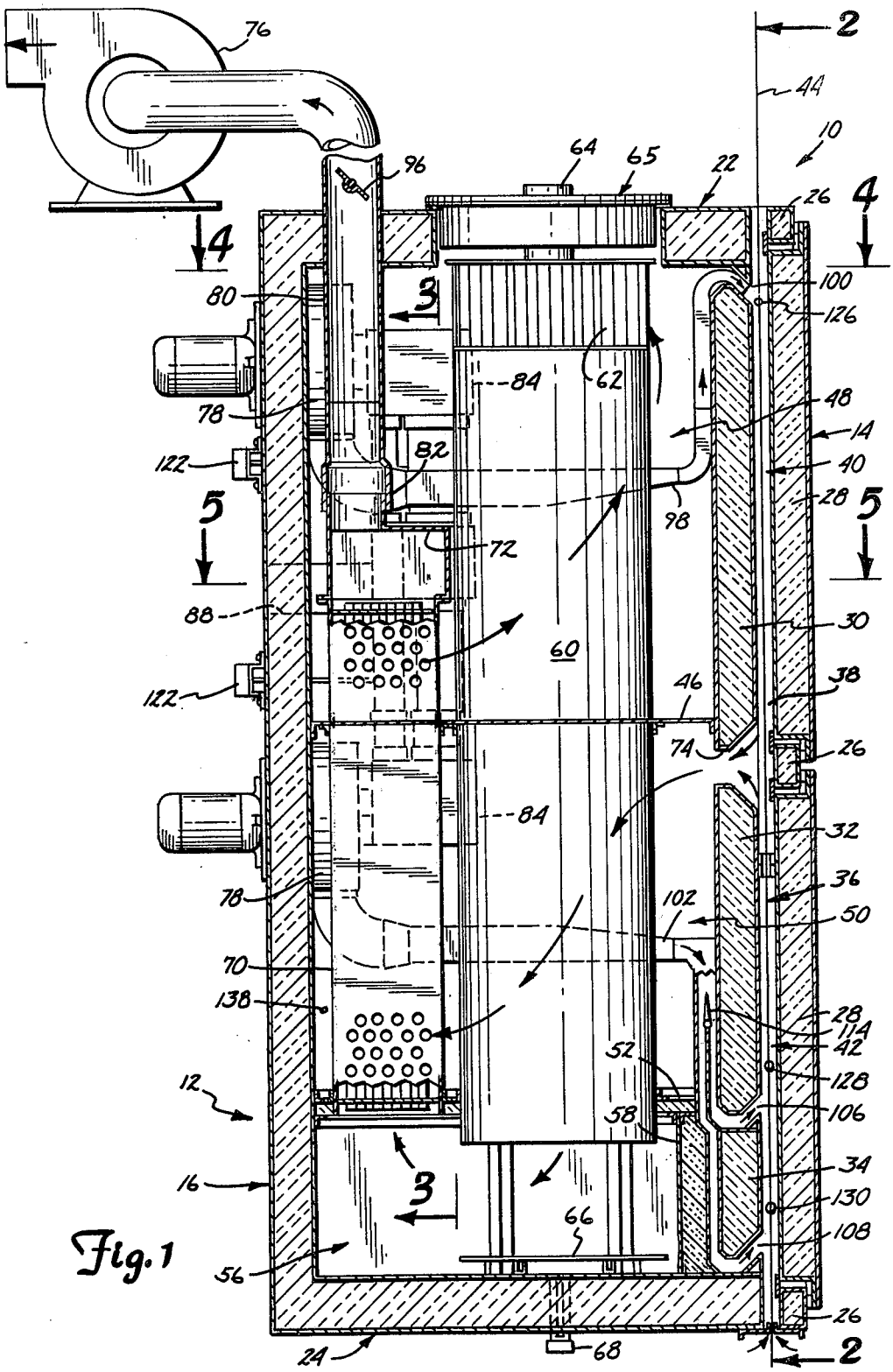
FIG. 1 is a vertical section view of a curing oven for enameled wire incorporating the invention.

Referring now to the Drawings, wherein like reference numerals designate corresponding elements throughout the views, there is shown an oven 10 incorporating the invention. Oven 10 is particularly adapted for curing wire coated with enamel on a continuous basis to form magnet wire, however, it will be appreciated that the invention can easily be adapted for drying or curing other types of items continuously conveyed along an input path. For purposes of illustration and discussion, the invention will thus be discussed only in reference to a wire enameling oven.

Oven 10 comprises a generally rectangular casing 12 having spaced apart front and rear walls 14 and 16, side walls 18 and 20, and top and bottom walls 22 and 24. The front wall 14 includes a plurality of vertically spaced apart horizontal cross members 26 extending between side walls 18 and 20, and removable access doors 28. The walls and doors comprising casing 12 are preferably of double wall construction including inner and outer layers of metal with insulation therebetween.

The interior of casing 12 is divided into several chambers and passageways by means of partitions. Three vertical insulated partitions 30, 32 and 34 extend between side walls 18 and 20 in vertical alignment and cooperate with portions of the top and bottom walls 22 and 24 to form an elongated work chamber 36 with the front wall 14. Work chamber 36 is preferably separated by a vertical divider 38 into lateral pairs of upper curing zones 40 and lower evaporating zones 42. In spaced apart side-by-side arrangement, lines of wire 44 coated with liquid insulator, such as enamel, pass upwardly through the work chamber 36 of oven 10 first through the evaporating zone 42 and then through the curing zone 40. Separations are provided at the vertical ends of the insulated partitions 30, 32 and 34 to direct air flow through the work chamber 36 as will be explained more fully hereinbelow.

A first horizontal partition 46 extends between the inside surfaces of partition 30, side walls 18 and 20, and back wall 16 to define an upper combustor chamber 48 and an intermediate chamber 50 within the casing 12. A second horizontal insulated partition 52 extends between a vertical duct 102, which is spaced inwardly from the vertical partitions 32 and 34, and side walls 18 and 20 and back wall 16 to separate the outlet combustor chamber 56 from the intermediate chamber 50. An insulated partition 58 extends between partition 52 and the inside surfaces of bottom wall 24 and side walls 18 and 20 in spaced relationship behind partition 34 to form a space therebetween for the duct 102, which is described more fully below.

An elongated combustor tube 60 is mounted inside casing 12. The combustor tube 60 extends through partitions 46 and 52 and chamber 50 therebetween, interconnecting the combustor chambers 48 and 56 in fluid communication. Radial vanes 62 are provided around the upper end of the combustor tube 60, which is spaced downwardly from the inside surface of the upper casing wall 22 for expansion purposes.

A burner 64 extends downwardly through an insulated, removable plug 65 in wall 22 and into the upper end of the combustor tube 60 in the inlet combustor chamber 48. Burner 64 can be constructed similar to the burner shown in U.S. Pat. No. 3,810,736, the disclosure of which is incorporated herein by reference; however, any suitable burner can be utilized. Primary combustion for the burner 64 is provided by natural gas, or other suitable fuel. As burner 64 burns downwardly, air within the chamber 48 is pulled through vanes 62 and around the upper end of tube 60. The resultant superheated combustion produces are drawn downwardly through tube 60 and onto heat shield 66 in outlet combustor chamber 56. A sight glass 68 can be mounted in the bottom wall 24 of casing 12 for looking through an opening (not shown) in shield 66 to monitor the flame of burner 64. It will thus be apparent that burner 64 combusts gas from chamber 48 and directs the resultant superheated combustion products downwardly through tube 60 into the outlet combustor chamber 56.

A heat exchanger 70 is located inside casing 12 between the combustor tube 60 and the back wall 16. The heat exchanger 70 comprises a substantially conventional parallel flat plate unit defining two separate fluid flow paths. The heat exchanger 70 is mounted in suitable openings in partitions 46 and 52 in fluid communication with chambers 48 and 50. Superheated combustion products from the outlet combustor chamber 56 enter the lower end of the exchanger 70 and passes upwardly along one flow path to a plenum 72 mounted on the other end of the heat exchanger. Simultaneously, air from work chamber 36, together with volatile vapors from the enamel on wires 44, enter the intermediate chamber 50 through the passageway 74 defined between adjacent ends of partitions 30 and 32 and pass along the other fluid path through the heat exchanger 70 and on into the upper combustor chamber 48 for combustion by burner 64. It will thus be appreciated that "process" air from the work chamber 36 together with volatile vapors given off by the coating on wires 44 as it evaporates and cures are first preheated in the heat exchanger 70 before being directed to the burner 64 to effect oxidation of the fumes. This preheating step of the process is an important feature of the present invention.

Air flow through the oven 10 is effected by a single exhaust fan 76 and multiple recirculation fans 78, both of which are connected directly or indirectly to the plenum 72. The exhaust fan 76, which is preferably of the constant speed type, is connected to plenum 72 through an exhaust pipe 80 and expansion joint 82, and serves to exhaust excess hot combustion gases which have passed through the heat exchanger 70 from chamber 56. The recirculation fans 78, which also are preferably of the constant speed type, are indirectly connected in plenum 72 via mixing boxes 84. Each mixing box 84 in turn is connected directly to the plenum 72 by duct 86, as well as to an open outside air intake 88 extending through the back wall 16 by duct 90. The purpose of recirculation fans 78 is thus to draw into their associated mixing boxes 84 cold outside air from intakes 88 as well as hot combustion gases from plenum 72. Motorized dampers 92 and 94 are provided in each associated pair of ducts 86 and 90, respectively, to control the relative volumes of cold outside air and hot combustion gases drawn into their corresponding mixing boxes 84. Another motorized damper 96 is located in the exhaust pipe 80 for controlling the volume of excess hot combustion gases exhausted from the heat exchanger 70. A separate recirculation fan 78, mixing box 84, and motorized damper assembly including dampers 92 and 94, are provided for each evaporating zone 42 and curing zone 40 in the work chamber 36 of oven 10. This comprises another significant feature of the present invention, as will become more apparent hereinafter.

The inlet sides of recirculating fans 78 are connected to their associated mixing boxes 84, while the outlet sides thereof are connected to appropriate ductwork leading to the work chamber 36. In the case of the curing zones 40, the outlet sides of their recirculation fans 78 are connected to ducts 98 extending an opposite sides of the combustor tube 60 in chamber 48 to the lateral passageways 100 defined between the upper ends of partitions 30 and the upper casing wall 22. In the case of the evaporating zones 42, the outlet sides of their corresponding recirculation fans 78 are connected by ducts 102 to passageways 106 and 108 opening onto the work chamber 36 near the inlet end thereof. Passageway 106 is defined by the separation between the adjacent ends of partitions 32 and 34, while passageway 108 is defined by the separation between the bottom edge of partition 34 and bottom wall 24.

Dampers 110 and 112, which can be either fixed in preset positions or adjustable by means of shafts and knobs 111 and 113, respectively, located outside casing 12, are provided in ducts 98 and 102, respectively, for volumetric control purposes. If desired, dampers 110 and 112 can be motorized and automatically controlled similarly to dampers 92 and 94, but responsive to preprogrammed or other conditions. Dampers 110 and 112 can thus be fixed or manually or automatically adjusted to the desired settings in accordance with the operating conditions of oven 10.

Although the preferred embodiment as illustrated incorporates constant speed recirculation fans 78 together with volumetric control dampers 110 and 112, it will be apparent that variable speed fans could be used. Variable speed fans are considered fully equivalent to constant speed fans and volumetric control dampers. Similarly, a variable speed fan could be substituted for exhaust fan 76 and volumetric control damper 96.

A damper 114, which can be manually adjustable with knob 116 located on the outside of the oven casing 12, is preferably provided in the throat of each vertical duct 102 to adjust relative flow through passageways 106 and 108 as necessary for evaporative temperature gradient control in the associated zone 42. As with dampers 110 and 112, dampers 114 also can be motorized and automatically adjusted to the desired settings in accordance with the particular operating conditions of oven 10.

Oven 10 operates as follows. Assume that exhaust fan 76 and recirculation fans 78 are energized, that burner 64 is ignited and burning downwardly through the combustor tube 60, and that wire 44 coated with liquid enamel is being fed through the work chamber 36. The process air, which comprises a relatively small amount of room air inspirated through the ends of the work chamber 36 together with the heated mixtures of gas flowing through passageways 100, 106 and 108 and volatile fumes carried thereby from the enamel on wire 44, is drawn inwardly along the work chamber and through passageway 74 into chamber 50. The small amount of room air inspirated through the open ends of work chamber 36 would typically be at about 70° F., whereas the "dirty" process air drawn through passageway 74 into chamber 50 would typically be at 700° to 850° F. From chamber 50, the process air passes through the heat exchanger 70 for preheating before entering chamber 48 for combustion by burner 64 so that the volatile vapors from the solvent in the enamel on wire 44 are substantially completely oxidized to the point of being neither objectionable nor harmful. The superheated combustion gases, typically at about 1,350° F., are directed downwardly through tube 60 to chamber 56 and heat exchanger 70 for preheating the process air from work chamber 36. After passage through the heat exchanger 70, the "clean" combustion gases at about 1,200° F. enter the hot air plenum 72. Hot gases from the hot air plenum 72, together with room air at about 70° F. from the intakes 88, are drawn by recirculation fans 78 into the mixing boxes 84 to form a gas mixture of 700° to 1,100° F. which is then directed through ducts 98 and 102 and respectively discharged into the curing and evaporating zones 40 and 42 of the work chamber 36 for temperature control thereof. Typically, the temperature within work chamber 36 would be about 400° F. along partition 34 and about 700° F. along partition 32, in the evaporating zone 42, while the temperature would be relatively higher at about 950° F. along partition 30 in the curing zone 40. Excess hot combustion gases from the heat exchanger 70 are exhausted from the hot air plenum 72 past the volumetric control damper 96 by the exhaust fan 76. The proportionate mixture of outside air and combustion gases drawn into mixing boxes 84 is individually controlled by the corresponding pair of motorized dampers 92 and 94. Temperature gradient control along the evaporating zone 42 is controlled by the manually adjustable damper 114.

If desired, gravity biased doors 117 can be provided in partition 52 together with gravity biased access doors 118 in side walls 18 and 20 adjacent to chamber 50 for pressure relief and thus safety purposes in the event of an explosion.

Figure 9:
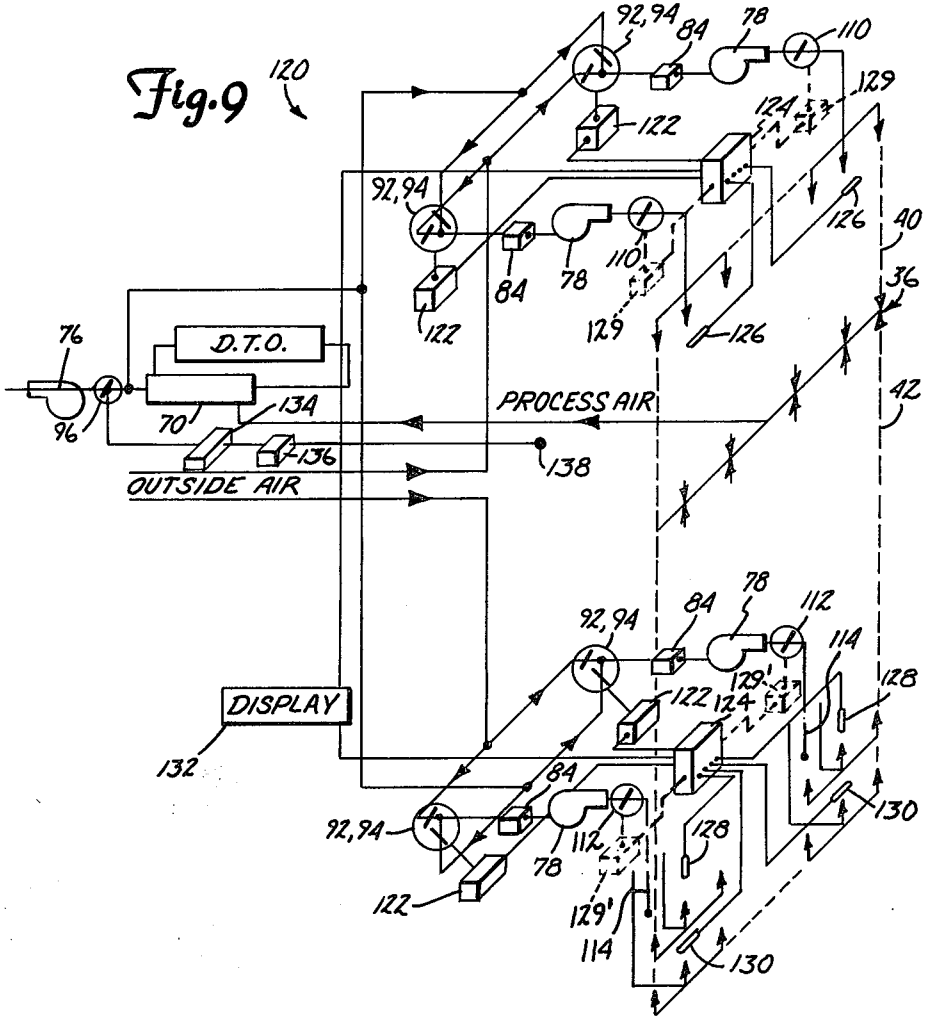
FIG. 9 is a schematic diagram of the control system for the wire enameling oven herein.
Figure 2:
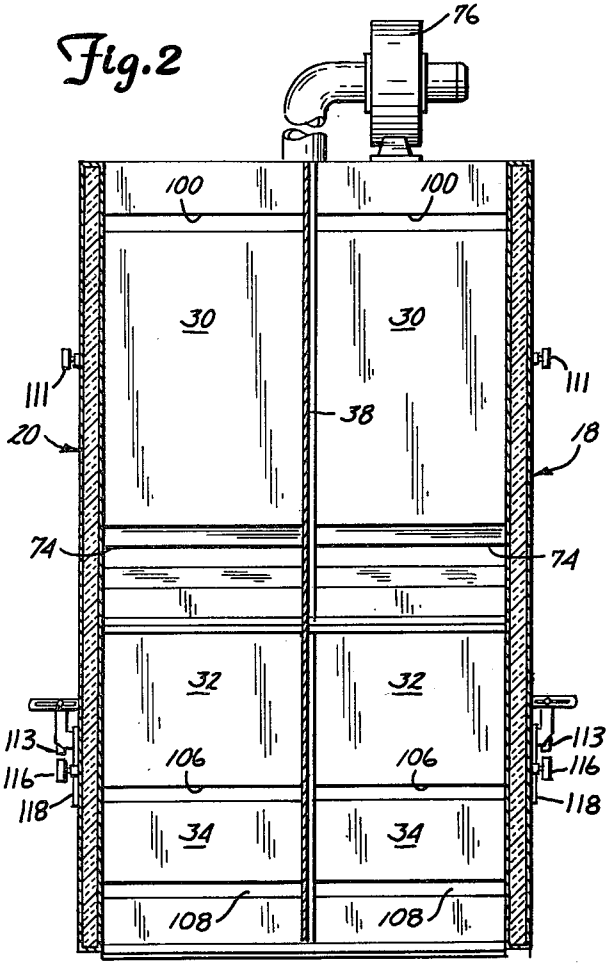
FIG. 2 is a reduced sectional view taken along lines 2—2 of FIG. 1 in the direction of the arrows.
Figure 3:
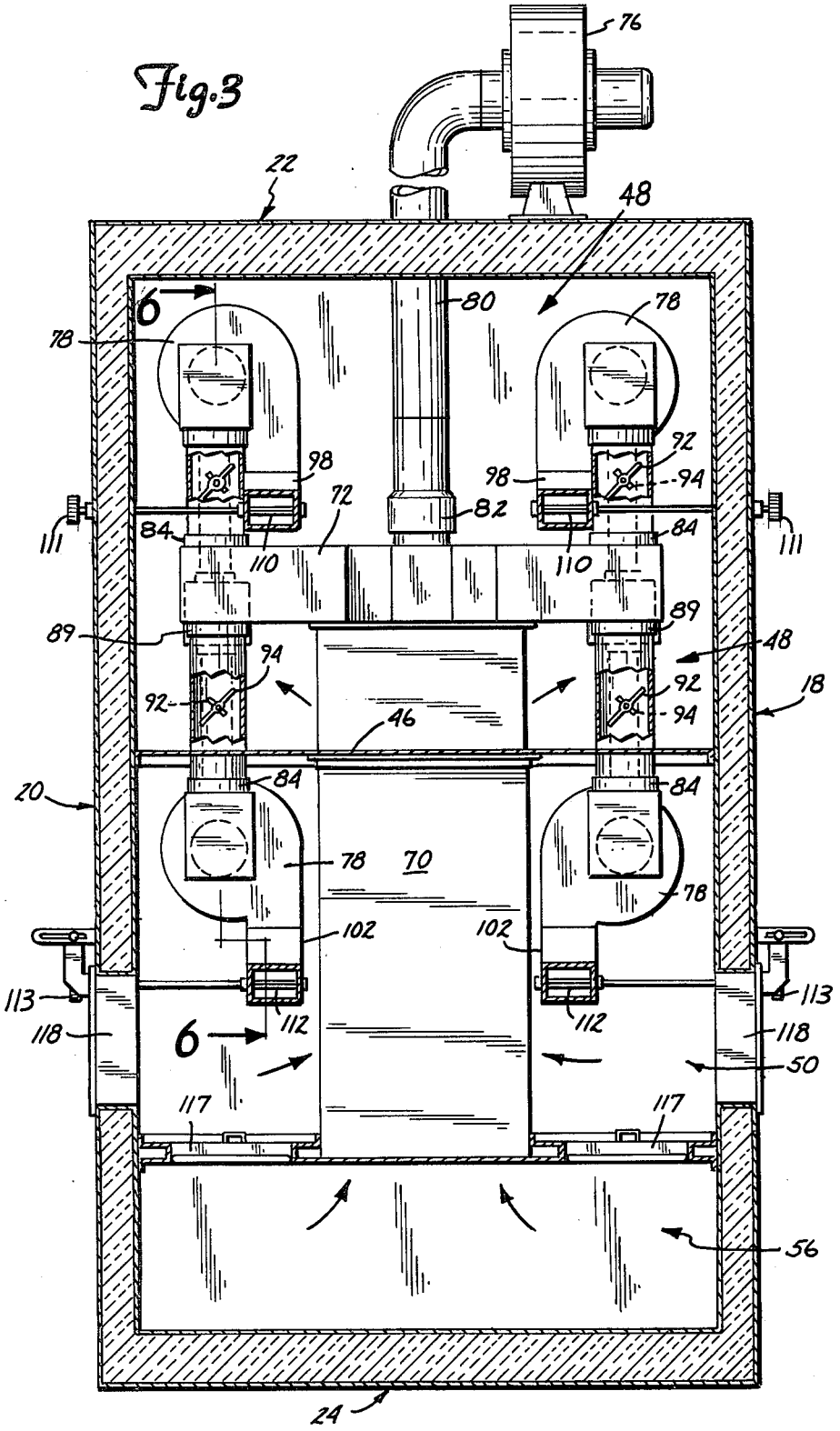
FIG. 3, is a vertical sectional view taken along lines 3—3 of FIG. 1 in the direction of the arrows.
Figure 4:
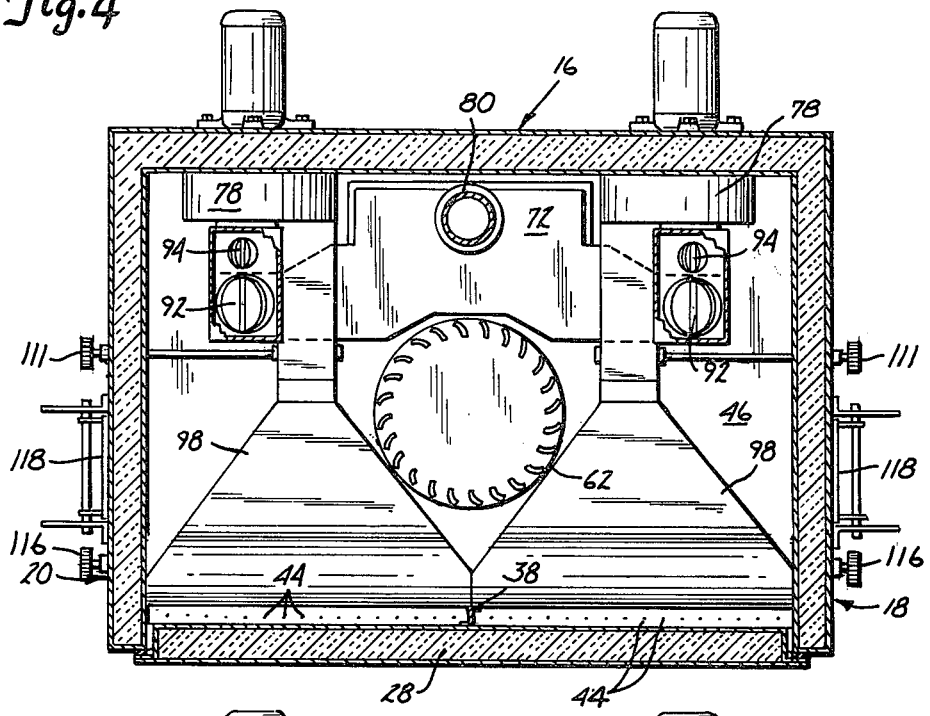
FIGS. 4 and 5 are horizontal sectional view taken along lines 4—4 and 5—5 of FIG. 1, respectively, in the direction of the arrows.
Figure 5:
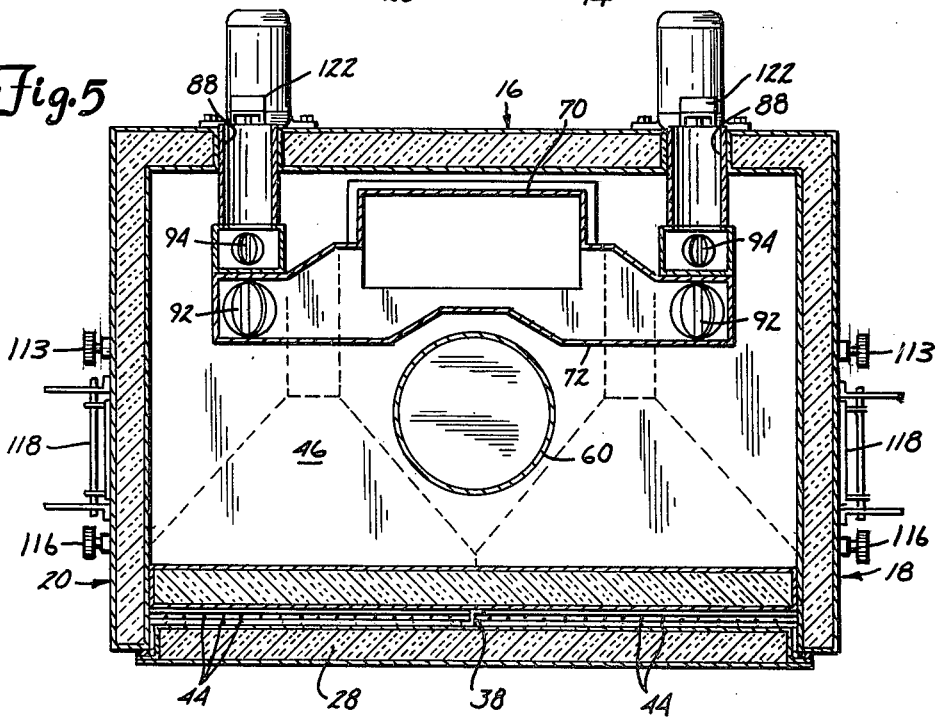

Referring now to FIG. 9, there is shown the control system 120 for the wire enameling 10 herein. Although dampers 92 and 94 in each corresponding pair could be separately actuated, each pair of dampers is preferably mounted on a common shaft operated by a single motor 122 or other suitable actuator, as is best seen in FIG. 6. Motors 122 in turn are controlled by microprocessor controllers 124 responsive to temperature sensors or thermocouples positioned in the work chamber 36. As illustrated, a separate microprocessor controller 124 is provided for each pair of curing zones 40 and each pair of evaporating zones 42; however, a separate microprocessor controller could be provided for each zone or a single central microprocessor with adequate capacity could be employed to control all of the zones, and it will be understood that the use of multiple controllers is not critical to practice of the invention. A suitable microprocessor would be the Honeywell UDC 500 digital controller, for example.

Motors 122 for the dampers 92 and 94 corresponding to the curing zone 40 are automatically controlled by the microprocessor controller 124 responsive to temperature sensors or thermocouples 126 located in the work chamber 36 near passageways 100, while the motors for the mixing dampers corresponding to the evaporating zone 42 are controlled by the microprocessor responsive to thermocouples 128 located in the work chamber near passageways 106. As shown in phantom lines in FIG. 9, the volumetric control dampers 110 associated with the rcirculation fans 78 are operated by motors 129 automatically controlled by the microprocessor 124, instead of manual knobs 111. Dampers 114 can be adjusted as necessary by reference to temperature sensors or thermocouples 130 located in the work chamber 36 near passageways 108.

Dampers 114 may also be motorized and automatically controlled by the microprocessor controller 124 responsive to thermocouples 130. If desired, a display 132 can be connected to the microprocessors 124 to present a visual readout of the sensed conditions within oven 10.

The box labeled D.T.O. in FIG. 9 represents the direct thermal oxidizer comprised of burner 64 and combustor tube 60.

With respect to the exhaust fan 76, which operates at substantially constant speed, the volumetric damper 96 is actuated by a motor 134 controlled by a controller 136 responsive to a pressure sensor 138 located in chamber 50 of the oven 10. Controller 136 preferably comprises a digital device like that shown in U.S. Pat. No. 3,677,335, also assigned to the assignee hereof, the disclosure of which is incorporated herein by reference. In order to contain the pollutants therein the oven 10 must operate at a slightly negative pressure relative to ambient air pressure. Since more outside air through inlets 88 is required if lower operating conditions are to be maintained in the work chamber 36, then more hot gases must be exhausted by the exhaust fan 76 to maintain the oven at a predetermined negative pressure. Fan 76 thus operates at substantially constant speed and damper 96 provides volumetric control of the exhaust.

From the foregoing, it will thus be apparent that the present invention comprises a curing oven and control system therefor having numerous advantages over the prior art. Pollution control is accomplished by direct thermal oxidation of volatile fumes released by the coating of enamel. The system herein can be classified as constant volume/variable temperature as opposed to the constant temperature/variable volume systems of the prior art. Separate motorized dampers, mixing boxes and recirculation fans are provided for each zone in the work chamber, and proper temperature control is automatically maintained by a microprocessor responsive to temperature sensors in the oven. Maintenance of the oven at a predetermined pressure less than ambient for environmental control and burner operating economy is achieved by an exhaust fan and motorized damper responsive to a pressure sensor inside the oven. Other advantages will be evident to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, equivalents, modifications and/or rearrangements of elements falling within the scope of the invention as defined by the following claims.

We claim:

1. A curing oven for coated product, comprising:

casing means defining an elongated work chamber for receiving coated product to be cured, said work chamber having an evaporating zone adjcent an inlet end and a curing zone adjacent an outlet end;

partition means within said casing means for defining an upper chamber, an intermediate chamber in fluid communication with the evaporating and curing zones of said work chamber, and a lower chamber;

a combustor tube having an inlet end located in said upper chamber and an outlet end located in said lower chamber;

a burner disposed in the inlet end of said combustor tube;

a hot air plenum;

heat exchanger means defining a first flow path fluidly connecting said lower chamber with said hot air plenum, and a second flow path fluidly interconnecting said upper and intermediate chambers such that process air from the work chamber is preheated before oxidation by said burner;

means defining a cold air intake in fluid communication with air outside said casing means;

means fluidly connected to said hot air plenum and cold air intake means for mixing outside air and combustion gases to a predetermined temperature and directing the resultant mixture into the curing and evaporating zones of the work chamber; and means connected to said hot air plenum for exhausting hot air from the oven.

2. The oven of claim 1, wherein said casing means is formed from panels comprised of insulation sandwiched between metal sheets.

3. The oven of claim 1, wherein said partition means comprises a plurality of vertically spaced apart aligned vertical panels in spaced relation with a front wall of said casing means, and a pair of vertically spaced apart horizontal panels extending between the vertical panels and side and back panels of said casing means.

4. The oven of claim 1, wherein said heat exchanger means is of the flat, parallel plate-type.

5. The oven of claim 1, wherein said mixing means comprises:

a pair of mixing boxes fluidly connected between said cold air intake means and said hot air plenum;

first damper means for controlling the relative amounts of hot and cold air admitted to each mixing box; and a recirculation fan fluidly connected between each mixing box and associated zone of the work chamber.

6. The oven according to claim 5, further including:

second damper means located between each recirculating fan and associated zone of the work chamber.

7. The oven of claim 1, wherein said exhaust means comprises:

an exhaust fan fluidly connected to said hot air plenum; and damper means for controlling the amount of air exhausted from the oven by said exhaust fan.

8. A curing oven for coated wire, comprising:

casing means defining an elongate work chamber for receiving coated wire to be cured;

partition means within said casing means for defining an upper chamber, an intermediate chamber in fluid communication with said work chamber, and a lower chamber;

a combustor tube having an inlet end located in said upper chamber and an outlet end located in said lower chamber;

a burner disposed in the inlet end of said combustor tube;

a hot air plenum;

heat exchanger means defining a first flow path fluidly connecting said lower chamber with said hot air plenum, and a second flow path fluidly interconnecting said upper and intermediate chambers such that process air from the work chamber is preheated before oxidation by said burner;

means defining a cold air intake in fluid communication with air outside said casing means;

a mixing box fluidly connected between said cold air intake means and said hot air plenum;

damper means for controlling the relative amounts of hot and cold air admitted to said mixing box for temperature control of the resultant mixture;

means including a recirculation fan fluidly connected between said mixing box and work chamber for directing the resultant mixture into said work chamber; and means connected to said hot air plenum for exhausting hot air from the oven.

9. The oven of claim 8, wherein said casing means is formed from panels comprised of insulation sandwiched between metal sheets.

10. The oven of claim 8, wherein said partition means comprises a plurality of vertically spaced apart aligned vertical panels in spaced relation with a front wall of said casing means, and a pair of vertically spaced apart horizontal panels extending between the vertical panels and side and back panels of said casing means.

11. The oven according to claim 8, further including:

second damper means located between each recirculating fan and associated zone of the work chamber.

12. The oven of claim 8, wherein said exhaust means comprises:

an exhaust fan fluidly connected to said hot air plenum; and exhaust damper means for controlling the amount of air exhausted from the oven by said exhaust fan.

13. The oven of claim 8, further including:

explosion relief doors mounted in said casing means adjacent to the intermediate chamber thereof.

14. A curing oven for coated wire, comprising:

casing means defining an elongate work chamber for receiving coated wire to be cured, said work chamber having an evaporating zone adjacent an inlet end and a curing zone adjacent an outlet end;

partition means within said casing means for defining an upper chamber, an intermediate chamber in fluid communication with the evaporating curing zones of said work chamber, and a lower chamber;

a combustor tube having an inlet end located in said upper chamber and an outlet end located in said lower chamber;

a burner disposed in the inlet end of said combustor tube;

a hot air plenum;

heat exchanger means defining a first flow path fluidly connecting said lower chamber with said hot air plenum, and a second flow path fluidly interconnecting said upper and intermediate chambers such that process air from the work chamber is preheated before oxidation by said burner;

means defining a cold air intake in fluid communication with air outside said casing means;

a pair of mixing boxes fluidly connected between said cold air intake means and said hot air plenum;

first damper means for controlling the relative amounts of hot and cold air admitted to each mixing box for temperature control of the resultant air mixture;

means including a recirculating fan fluidly connected between each mixing box and associated zone of said work chamber for directing the resultant mixture into the curing and evaporating zones of said work chamber, respectively;

means including an exhaust fan fluidly connected to said hot air plenum; and second damper means for controlling the amount of air exhausted from the oven.

15. The curing oven of claim 14, further including:

third damper means located between each recirculating fan and corresponding zone of the work chamber.

16. The curing oven of claim 14, wherein said connecting means between said mixing box and corresponding evaporating zone of the work chamber defines a split passageway for directing the resultant mixture of air into the evaporating zone at two spaced apart locations; and further including:

fourth damper means for adjusting the relative amounts of flow through the split passageway for temperature gradient control in the evaporating zone.

17. Apparatus for automatically curing coated wire on a continuous basis, comprising:

casing means defining an elongate work chamber for receiving coated wire to be cured;

partition means within said casing means for defining an upper chamber, an intermediate chamber in fluid communication with said work chamber, and a lower chamber;

a combustor tube having an inlet end located in said upper chamber and an outlet end located in said lower chamber;

a burner disposed in the inlet end of said combustor tube;

a hot air plenum;

heat exchanger means defining a first flow path fluidly connecting said lower chamber with said hot air plenum, and a second flow path fluidly interconnecting said upper and intermediate chambers such that process air from the work chamber is preheated before oxidation by said burner;

means defining a cold air intake in fluid communication with air outside said casing means;

a mixing box fluidly connected between said cold air intake means and said hot air plenum;

a temperature sensor located in the work chamber;

damper means for controlling the relative amounts of hot and cold air admitted to said mixing box for temperature control of the resultant mixture;

means for controlling said damper means responsive to said temperature sensor to maintain predetermined temperatures in a zone of the work chamber;

means including a recirculating fan fluidly connected between said mixing box and work chamber for directing the resultant mixture into said work chamber; and means connected to said hot air plenum for exhausting hot air from the oven.

18. The apparatus of claim 17, wherein said controlling means comprises a microprocessor.

19. The apparatus of claim 17, further including: second damper means located between said recirculating fan and the work chamber.

20. The apparatus of claim 17, further including:

exhaust damper means for adjusting the amount of air exhausted from the oven;

a pressure sensor positioned inside the intermediate chamber; and means for controlling said exhaust damper means responsive to said pressure sensor to maintain the oven at a predetermined pressure less than ambient.

21. Apparatus for automatically curing coated wire on a continuous basis, comprising casing means defining an elongate work chamber for receiving coated wire to be cured, said work chamber having an evaporating zone adjacent an inlet end and a curing zone adjacent an outlet end;

partition means within said casing means for defining an upper chamber, an intermediate chamber in fluid communication with the evaporation curing zones of said work chamber, and a lower chamber;

a combustor tube having an inlet end located in said upper chamber and an outlet end located in said lower chamber;

a burner disposed in the inlet end of said combustor tube;

a hot air plenum;

heat exchanger means defining a first flow path fluidly connecting said lower chamber with said hot air plenum, and a second flow path fluidly interconnecting said upper and intermediate chambers such that process air from the work chamber is preheated before oxidation by said burner;

means defining a cold air intake in fluid communication with air outside said casing means;

a pair of mixing boxes fluidly connected between said cold air intake means and said hot air plenum;

a pair of temperature sensor, one located in the curing zone and the other located in the evaporating zone of the work chamber;

first damper means for controlling the relative amount of hot and cold air admitted to each mixing box for temperature control of the resultant air mixture;

means for controlling said first damper means responsive to the associated temperature sensors to maintain predetermined temperatures in the curing and evaporating zones of the work chamber;

means including a recirculating fan fluidly connected between each mixing box and associated zone of said work chamber for directing the resultant mixture into the curing and evaporating zones of said work chamber;

means including an exhaust fan fluidly connected to said hot air plenum; and second damper means for controlling the amount of air exhausted from the oven.

22. The apparatus of claim 21, further including:

a pressure sensor located inside said casing means; and means for controlling said second damper means responsive to said pressure sensor to maintain the oven at a predetermined pressure less than ambient.

23. A curing oven for coated product, comprising:

casing means defining an elongated work chamber for receiving coated product to be cured, said work chamber having an evaporating zone adjacent an inlet end and a curing zone adjacent an outlet end;

partition means within casing means for defining an upper chamber, an intermediate chamber in fluid communication with the evaporating and curing zones of said work chamber, and a lower chamber;

a combustor tube having an inlet end located in said upper chamber and an outlet end located in said lower chamber;

a burner disposed in the inlet end of said combustor tube;

a heat exchanger means defining a first flow path fluidly connected to said lower chamber, and a second flow path fluidly interconnecting said upper and intermediate chambers such that process air from the work chamber is preheated before oxidation by said burner;

means defining a cold air intake in fluid communication with air outside said casing means;

means fluidly connected to said first flow path of said heat exchanger means and said cold air intake means for mixing outside air and combustion gases to separate predetermined temperatures and directing the resultant mixtures into the curing and evaporating zones of the work chamber; and means connected to the first flow path of said heat exchanger means for exhausting hot air from the oven.

24. A curing oven for coated wire, comprising:

casing means defining an elongate work chamber for receiving product to be cured;

partition means within casing means for defining an upper chamber, an intermediate chamber in fluid communication with said work chamber, and a lower chamber;

a combustor tube having an inlet end located in said upper chamber and an outlet end located in said lower chamber;

a burner disposed in the inlet end of said combustor tube;

a heat exchanger means defining a first flow path fluidly connected to said lower chamber, and a second flow path fluidly interconnecting said upper and intermediate chambers such that process air from the work chamber is preheated before oxidation by said burner;

means defining a cold air intake fluid communication with air outside said casing means;

a mixing box fluidly connected between said cold air intake means and the first flow path of said heat exchanger means;

damper means for controlling the relative amount of hot and cold air admitted to said mixing box for temperature control of the restultant mixture;

means including a constant speed recirculating fan fluidly connected between said mixing box and work chamber for directing the resultant mixture into said work chamber; and means connected to the first flow path of said heat exchanger means for exhausting hot air from the oven.

25. A curing oven for coated product, comprising:

casing means defining an elongated work chamber for receiving coated product to be cured, said work chamber having an evaporating zone adjacent an inlet end and a curing zone adjacent an outlet end;

partition means within casing means for defining an upper chamber, an intermediate chamber in fluid communication with the evaporating and curing zones of said work chamber, and a lower chamber;

a combustor tube having an inlet end located in said upper chamber and an outlet end located in said lower chamber;

a burner disposed in the inlet end of said combustor tube;

heat exchanger means defining a first flow path fluidly connected to said lower chamber, and a second flow path fluidly interconnecting said upper and intermediate chambers such that process air from the work chamber is preheated before oxidation by said burner;

means defining a cold air intake in fluid communication with air outside said casing means;

a pair of mixing boxes fluidly connected to said cold air intake means;

first damper means for controlling the relative amounts of hot and cold air admitted to each mixing box for temperature control of the resultant air mixture;

means including a constant speed recirculating fan fluidly connected between each mixing box and associated zone of said work chamber for directing the resultant mixture into the curing and evaporating zones of said work chamber respectively;

means including a constant speed exhaust fan fluidly connected to the first flow path of said heat exchanger means; and second damper means for controlling the amount of air exhausted from the oven.

* * * * *